US005079495A

United States Patent [19]

Yasuo

[11] Patent Number: 5,079,495

[45] Date of Patent: Jan. 7, 1992

[54] CHARGE EXHAUSTION PREVENTING APPARATUS OF STORAGE BATTERY

[75] Inventor: Takashi Yasuo, Aichi, Japan

[73] Assignee: Imax Corporation, Aichi, Japan

[21] Appl. No.: 583,645

[22] Filed: Sep. 17, 1990

[30] Foreign Application Priority Data

Nov. 17, 1989 [JP] Japan ..... 1-134010[U]

[51] Int. Cl.[5] ..... H02J 7/14

[52] U.S. Cl. ..... 320/61; 320/62; 322/35

[58] Field of Search ..... 320/61, 62; 322/35

[56] References Cited

U.S. PATENT DOCUMENTS 3,921,052 11/1975 Milano ..... 320/61
4,122,381 10/1978 Sturm ..... 320/61
4,742,583 5/1988 Yoshida ..... 4/313
4,951,915 8/1990 Piao ..... 320/61

*Primary Examiner*—Steven L. Stephan
*Assistant Examiner*—Adolf Berhane
*Attorney, Agent, or Firm*—Kanesaka and Takeuchi

[57] ABSTRACT

A charge exhaustion preventing apparatus of a storage battery, includes a generator disposed on a waterway, a storage battery charged by the generator, an electromagnetic valve which opens and closes the waterway by the storage battery as the power source, a control portion which controls the action of the electromagnetic valve, and a capacity detecting portion which detects the capacity of the storage battery. The control portion actuates the electromagnetic valve to open so as to produce a stream of water when the capacity decreases below a certain capacity based on a detection signal from the capacity detecting portion, thereby to actuate the generator.

3 Claims, 3 Drawing Sheets

CHARGE EXHAUSTION PREVENTING APPARATUS OF STORAGE BATTERY

FIELD OF THE INVENTION AND RELATED ART STATEMENT

The present invention relates to a charge exhaustion preventive apparatus of a storage battery, and more particularly to an apparatus in which a generator is actuated by a stream of water so as to feed electricity to a storage battery and an electromagnetic valve or other equipments with the storage battery as a power source.

As an automatic flushing unit of a urinal, an apparatus of a type having an electromagnetic valve disposed on a waterway, a human body detecting sensor which detects a human body, and a control portion which performs actuation control of the electromagnetic valve, is widely used and in which a human body is detected with the human body detecting sensor when he stands in front of the urinal, the control unit actuates the electromagnetic valve to open based on the detection signal from the sensor, and flushing water is made to flow out automatically.

Now, in such an automatic flushing unit, it is being considered to dispose a generator on a waterway so as to generate power by a stream of water, thereby to charge a storage battery and to actuate the unit with such a storage battery as the power source. In this case, since the unit does not work if the capacity of the storage battery drops below a certain level, it is also considered to use a dry element battery as a backup battery. However, when the storage battery is to be backed up by a dry element battery, maintenance work becomes troublesome because the dry element battery has to be checked to find out if it has been consumed or has to be replaced.

Such problems are caused in common not only in an automatic flushing unit of a urinal, but also in an apparatus of a type in which a generator is disposed on a waterway so as to charge a storage battery and to actuate variety of equipments with this storage battery as the power source.

OBJECT AND SUMMARY OF THE INVENTION

It is an object of the present invention to provide a charge exhaustion preventive apparatus of a storage battery in which a dry element battery is not required in particular as a backup battery because charging of the storage battery is effected automatically, thus making it possible to omit troublesome work for the maintenance of the backup battery.

It is another object of the present invention to provide a charge exhaustion preventive apparatus of a storage battery in which the capacity of the storage battery is prevented from dropping below a certain level, thereby to omit a backup battery and thus to omit maintenance work of such a backup battery.

The subject matter of a first invention exists in that there are provided a generator disposed on a waterway, a storage battery charged by the generator, an electromagnetic valve which opens and closes the waterway with the storage battery as power source, a control portion which controls the action of the electromagnetic valve, and a capacity detecting portion which detects the capacity of the storage battery (remaining electric energy charged), and the control portion actuates the electromagnetic valve to open so as to produce a stream of water when the capacity decreases below a certain capacity based on a detection signal from the capacity detecting portion, thereby to actuate the generator.

In an apparatus of the present invention, the capacity of the storage battery is always monitored by means of the capacity detecting portion and the control portion, and the electromagnetic valve is actuated automatically thereby to actuate the generator when the capacity decreases below a predetermined capacity, that is, charging of the storage battery is performed automatically. Accordingly, it is not necessary to specially provide a dry element battery as a backup battery. Thus, troublesome work for the maintenance of the backup battery may be omitted.

The subject matter of a second invention exists in that there are provided a generator disposed on a waterway, a storage battery charged by the generator, an electromagnetic valve which opens and closes the waterway with the storage battery as the power source, a control portion which controls the action of the electromagnetic valve, and a capacity detecting portion which detects the capacity of the storage battery, and the control portion actuates the electromagnetic valve to open intermittently so as to produce a stream of water at a predetermined time interval obtained from a balance between power consumption and power supply, thereby to prevent the capacity of the storage battery from decreasing below a certain capacity.

In the automatic flushing unit of a urinal in which an electromagnetic valve, a sensor and the like are actuated with a storage battery as a power source, the electric energy stored in the storage battery is consumed usually with the lapse of time, and it is considered the consumption quantity increase as the elapsed time becomes longer. That is, it may be considered that the consumption quantity of the electric energy is a function of time.

According to the present invention, a generator is actuated intermittently at a predetermined time interval so as to charge a storage battery, and a time interval required for balancing the electric power consumed after the lapse of certain time with the electric power supplied by the generator is obtained, thereby to control action of the electromagnetic valve so that the electromagnetic valve operates intermittently at least within the time interval.

With this, the capacity of the storage battery is prevented from dropping below a certain level. Thus, the backup battery may be omitted, and maintenance work of such a backup battery can be omitted.

DESCRIPTION OF THE PREFERRED EMBODIMENTS

In the next place, an embodiment of the present invention will be described in detail with reference to the drawings.

Figure 2:
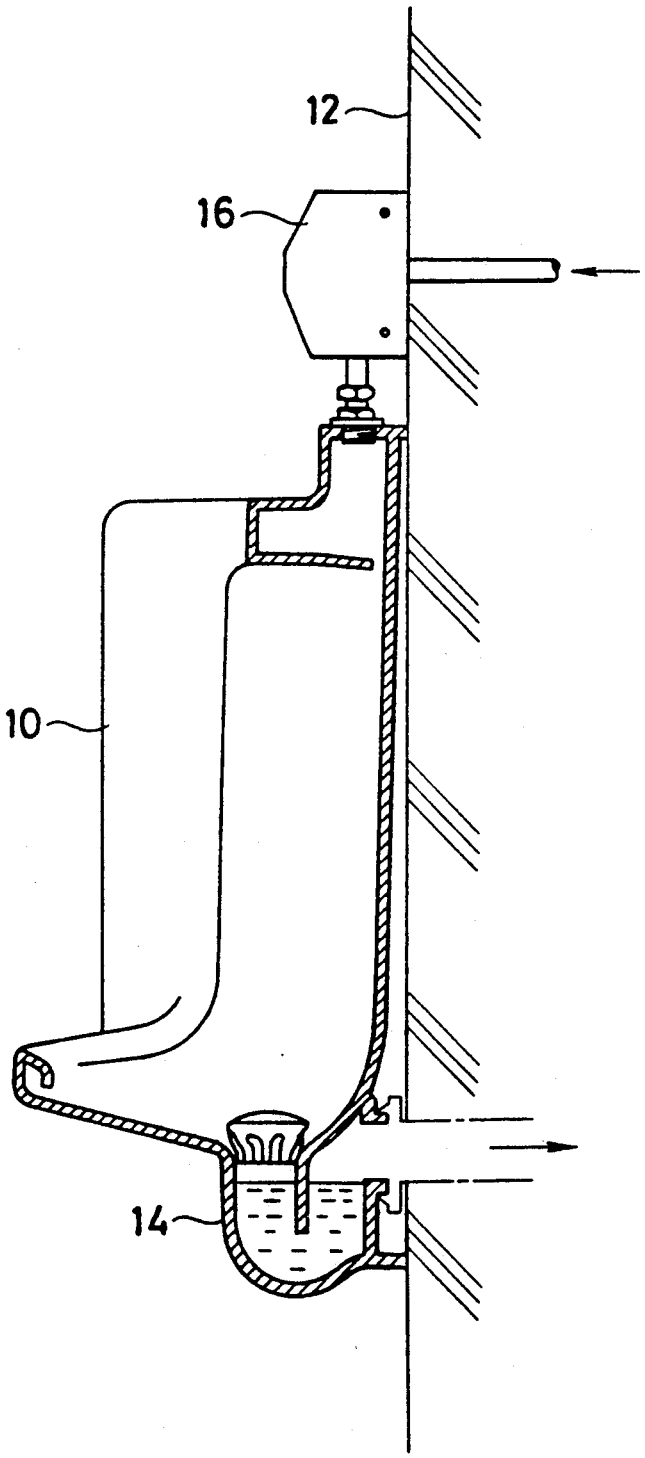
FIG. 2 is a side sectional view showing the automatic flushing unit shown in FIG. 1 along with a urinal.

In FIG. 2, 10 indicates a urinal installed adjacent to a wall surface 12, which has a trap portion 14 in the lower part thereof. By means of seal water at this trap portion 14, the back flow of odor from a drainage pipe is prevented.

Figure 1:
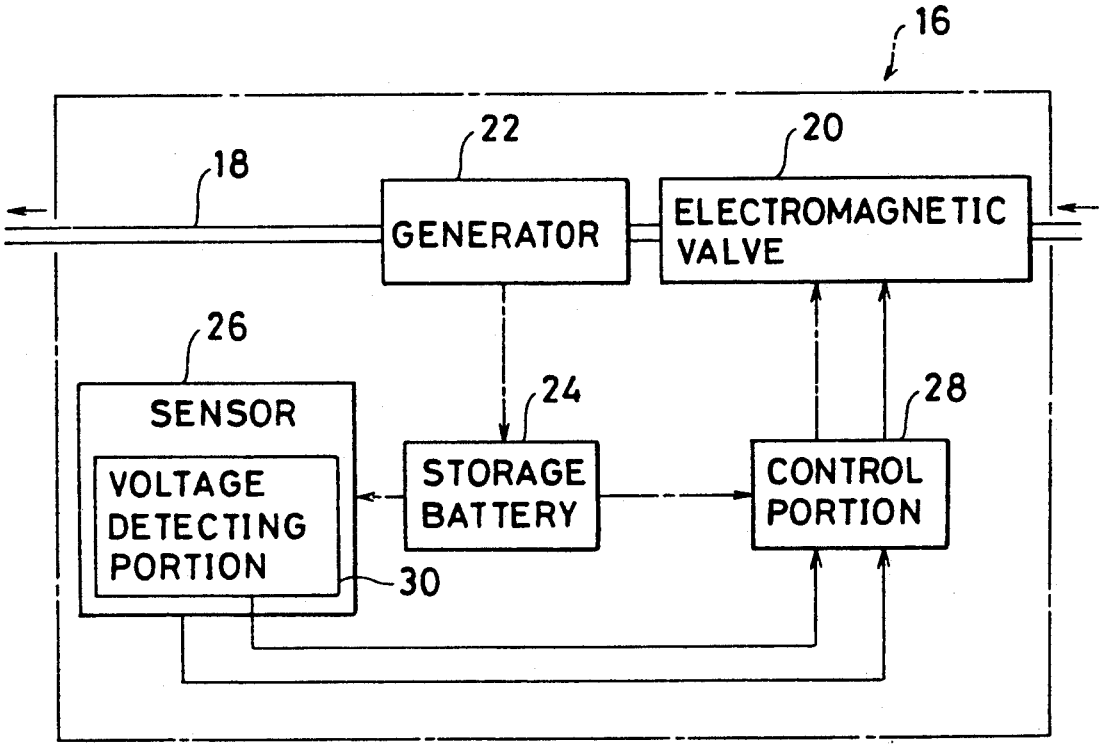
FIG. 1 is a block diagram showing an embodiment of an automatic flushing unit of the present invention.

16 indicates an automatic flushing unit of the urinal 10. An electromagnetic valve 20 is disposed on a waterway 18 as shown in FIG. 1, and communication and cutoff of the waterway are performed by the action of this electromagnetic valve 20.

A generator 22 is provided on the downstream side of the electromagnetic valve 20, and the storage battery 24 is charged by power generation of this generator 22.

The automatic flushing unit 16 of the present embodiment is provided additionally with a human body detecting sensor 26 and a control portion 28 which are actuated by the storage battery 24 as the power source. The sensor 26 detects a human body for example by emitting infrared rays and receiving a reflected light reflected by the human body, and the detected signal thereof is input to the control portion 28 and the control portion 28 actuates the electromagnetic valve 20 to open based on this signal so as to discharge flushing water.

In the circuit of this sensor 26, a voltage detecting portion 30 as a capacity detecting portion of the storage battery 24 is provided, and a signal from this voltage detecting portion 30 is input to the control portion 28. Thus, the control portion 28 actuates the electromagnetic valve 20 to open by the signal from this voltage detecting portion 30 when the voltage of the storage battery 24 drops below a certain voltage, thereby to actuate the generator 22 so as to charge the storage battery 24.

Furthermore, the control portion 28 actuates the electromagnetic valve 20 automatically after the lapse of certain time since flushing water was discharged lastly as the starting point.

Figure 3:
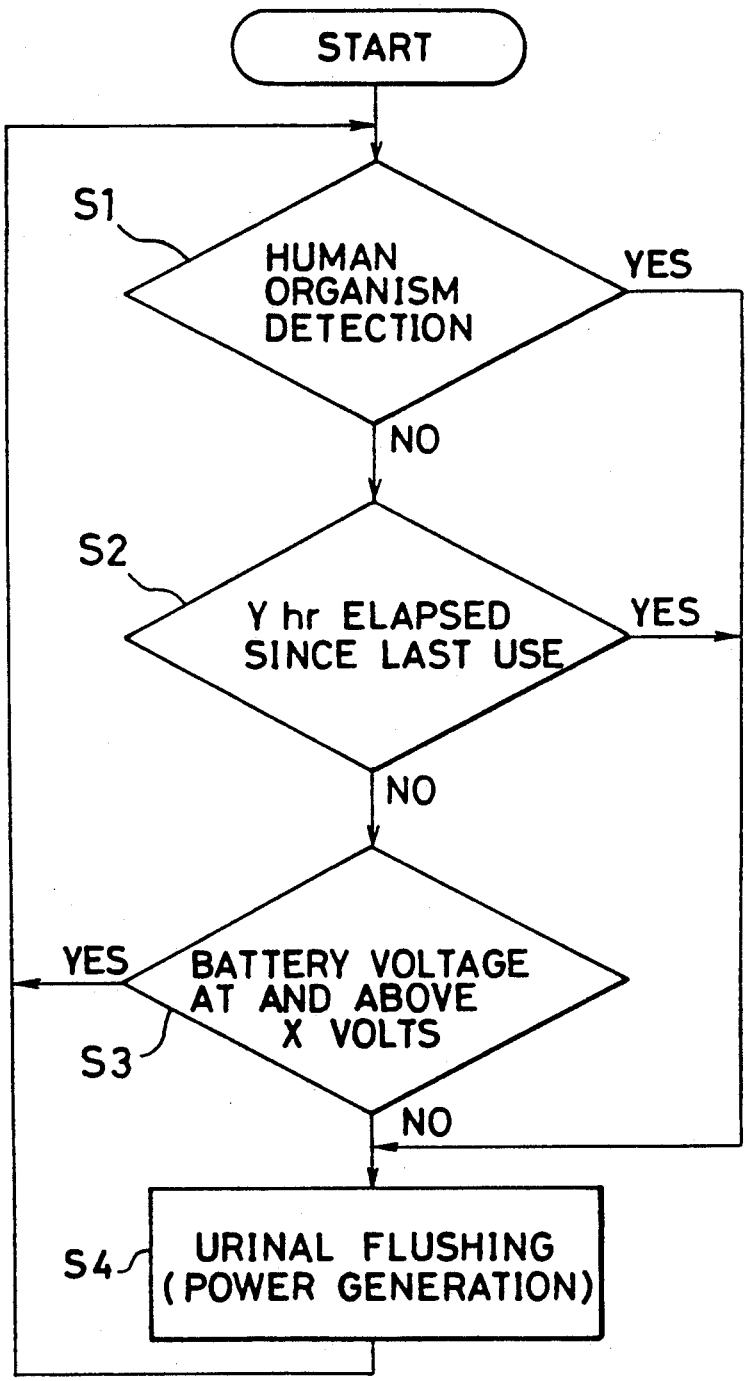
FIG. 3 is a flow chart showing contents of the control portion in the automatic flushing unit shown in FIG. 1.

The carrying-out procedures of the control by this control portion 28 are shown as a flow chart in FIG. 3. First, it is judged whether a human body is detected or not in step S1, and the process is jumped to S4 thereby to actuate the electromagnetic valve 20 when a human body is detected so as to flush the urinal 10. At this time, the generator 22 is naturally actuated so as to charge the storage battery 24.

On the other hand, when it is judged that no human body is detected in S1, it is judged whether a preset time y has elapsed or not since flushing water was discharged lastly, and the process is jumped to S4 so as to discharge flushing water when the time y has elapsed. Besides, this time y may be set at 8.5 hours for instance.

This time y has been obtained so that the voltage of the storage battery 24 does not drop below a certain voltage, whereby it is possible to prevent seal water from diminishing or disappearing by evaporation at the abovementioned trap portion 14 by flowing flushing water at least at a certain time interval. That is, the seal water at the trap portion 14 diminishes by evaporation after long time has elapsed without discharging flushing water and the trap action is suspended finally, thus causing odor to flow backwards, but the storage battery 24 is charged and the loss of trap action is prevented by discharging flushing water at least at a certain time interval.

Now, when it is judged that the time y has not elapsed yet since flushing water was discharged lastly in S2, it is judged in S3 whether the battery voltage is at and above a certain voltage (x volts), and flushing water is discharged when the battery voltage is lower than the certain voltage so as to charge the storage battery 24.

On the other hand, when the battery voltage is above the certain voltage, respective steps are executed again starting from S1 after discharging flushing water for a certain period of time in S4.

An automatic flushing unit which discharges flushing water automatically by detecting a human body with the sensor 26 has been described above as an example. However, the present invention may be modified based on the knowledge of those skilled in the art without departing from the spirit and scope of the present invention. For example, it is applicable to a unit in which a urinal is flushed by discharging flushing water at intervals of a certain time from a high tank (a water reservoir) installed near a ceiling of a toilet room, and is also applicable to other general units of a type which has an electromagnetic valve and a generator on a waterway and charges a storage battery by means of the generator so as to actuate variety of equipments.

What is claimed is:

1. A charge exhaustion preventing apparatus of a storage battery in a urinal unit having an odor trap portion and a waterway, comprising, a generator disposed in the waterway, a storage battery connected to the generator to be charged by the generator, an electromagnetic valve situated in the waterway and electrically connected to the storage battery, said valve being opened and closed by electricity stored in the storage battery, capacity detecting means connected to the storage battery for detecting capacity of the storage battery, and control means for controlling operation of the electromagnetic valve, said control means actuating said electromagnetic valve to open the waterway when the urinal unit is used and after a predetermined time has passed since preceding opening of the electromagnetic valve, said predetermined time being less than a time that power in the storage battery drops below a predetermined value so that stream of water in the waterway actuates the generator for generating and storing electricity in the storage battery thereby to prevent capacity of the storage battery from decreasing below the predetermined value and water is sufficiently supplied to the odor trap portion of the urinal unit to prevent odor from passing through the odor trap portion.

2. A charge exhaustion preventing apparatus of a storage battery in a unit with a waterway, comprising, a generator disposed in the waterway, a storage battery connected to the generator to be charged by the generator, an electromagnetic valve situated in the waterway and electrically connected to the storage battery, said valve being opened and closed by electricity stored in the storage battery, capacity detecting means connected to the storage battery for detecting capacity of the storage battery, and control means for controlling operation of the electromagnetic valve, said control means actuating said electromagnetic valve to open the waterway at one of the following conditions;

(1) when the unit is used, (2) after a predetermined time has passed since preceding opening of the electromagnetic valve, said predetermined time being less than a time that power in the storage battery drops below a predetermined value, and (3) when capacity of the storage battery is less than the predetermined value, water in the waterway, when the electromagnetic valve is opened, actuating the generator for generating and storing electricity in the storage battery thereby to prevent capacity of said storage battery from decreasing below the predetermined value.

3. A charge exhaustion preventing apparatus according to claim 2, wherein said unit is a urinal unit and having an odor trap portion, said odor trap portion, when water is supplied to the urinal unit at least within the predetermined time, being sufficiently covered by water to prevent odor from passing through the trap portion.

* * * * *

UNITED STATES PATENT AND TRADEMARK OFFICE

CERTIFICATE OF CORRECTION

PATENT NO. : 5,079,495

DATED : January 7, 1992

INVENTOR(S) : Takashi Yasuo

It is certified that error appears in the above-identified patent and that said Letters Patent is hereby corrected as shown below:

Title page, item [73] Assignee:

Change "Imax Corporation" to --Inax Corporation--.

Signed and Sealed this

Thirtieth Day of March, 1993

*Attest:*

STEPHEN G. KUNIN

*Attesting Officer*

*Acting Commissioner of Patents and Trademarks*